US006583701B2

(12) United States Patent
Sun et al.

(10) Patent No.: US 6,583,701 B2
(45) Date of Patent: Jun. 24, 2003

(54) INDUCTOR WITH VARIABLE AIR-GAP SEPARATION

(75) Inventors: Xiaodong Sun, Taipei Hsien (TW); Yanfang Liu, Taipei Hsien (TW)

(73) Assignee: Lite-On Electronics, Inc., Taipei Hsien (TW)

( * ) Notice: Subject to any disclaimer, the term of this patent is extended or adjusted under 35 U.S.C. 154(b) by 0 days.

(21) Appl. No.: 09/879,942

(22) Filed: Jun. 14, 2001

(65) Prior Publication Data

US 2003/0043006 A1 Mar. 6, 2003

(51) Int. Cl.[7] ..... H01F 17/06
(52) U.S. Cl. ..... 336/178; 336/234; 336/200
(58) Field of Search ..... 336/178, 134, 336/200, 212, 234

(56) References Cited

U.S. PATENT DOCUMENTS 4,874,990 A * 10/1989 Dobnick ..... 315/276
5,047,745 A * 9/1991 Marriott et al. ..... 336/217
5,155,676 A * 10/1992 Spreen ..... 363/126
5,371,486 A * 12/1994 Yamada et al. ..... 336/212
5,440,225 A * 8/1995 Kojima ..... 323/359
5,889,373 A * 3/1999 Fisher et al. ..... 315/307

FOREIGN PATENT DOCUMENTS

JP 355128809 * 10/1980 ..... 336/178

* cited by examiner

*Primary Examiner*—Anh Mai
(74) *Attorney, Agent, or Firm*—Rosenberg, Klein & Lee

(57) ABSTRACT

An inductor with multiple air-gap separations comprises a magnetic core and an enameled wire around the magnetic core. The magnetic core has an air gap with at least a large-gap portion and a small-gap portion. The small-gap portion provides enough inductance in case of low load input to prevent harmonic distortion. The large-gap portion provides enough inductance in case of heavy load output and low input voltage to prevent saturation and temperature rise, thus enhancing power efficiency.

4 Claims, 8 Drawing Sheets

INDUCTOR WITH VARIABLE AIR-GAP SEPARATION

FIELD OF THE INVENTION

The present invention relates to an inductor with multiple air-gap separations, especially to an inductor having air-gap with multiple separations to provide better electrical property.

BACKGROUND OF THE INVENTION

The prior art inductor for large-current application generally has large-volume silicon-steel plates, and an air gap for increasing reluctance thereof, thus preventing saturation of the inductor. As shown in FIG. 1A and FIG. 1B, an inductor 1A is composed of an I-shaped silicon-steel plate 11*a* and an B-shaped silicon-steel plate 12*a*, and an air gap 13*a* with uniform separation between the I-shaped silicon-steel plate 11*a* and the B-shaped silicon-steel plate 12*a*.

However, the air gap 13*a* with uniform separation has some disadvantages. If the air gap 13*a* is small, the inductor 1*a* is saturated and the inductance thereof is increased and temperature is increased in heavy load case (larger current). If the air gap 13*a* is large, the inductance is not enough to prevent harmonic distortion in low load case (small current). The temperature cannot be decreased to enhance efficiency in low output voltage and heavy load condition.

As can be seen from above description, the inductor having air gap with uniform separation has serious problem.

SUMMARY OF THE INVENTION

It is the object of the present invention to provide an inductor with multiple air-gap separations to overcome above problem.

To achieve above object, the present invention provides an inductor with multiple air-gap separations comprises a magnetic core and an enameled wire around the magnetic core. The magnetic core has an air gap with at least a large-gap portion and a small-gap portion. The small-gap portion provides enough inductance in case of low load input to prevent harmonic distortion. The large-gap portion provides enough inductance in case of heavy load output and low input voltage to prevent saturation and temperature rise. The air gap has a surface of stair shape, bevel shape or a curved surface to optimize the electrical property of the inductor.

The various objects and advantages of the present invention will be more readily understood from the following detailed description when read in conjunction with the appended drawing, in which:

DESCRIPTION OF THE INVENTION

Figure 1A:
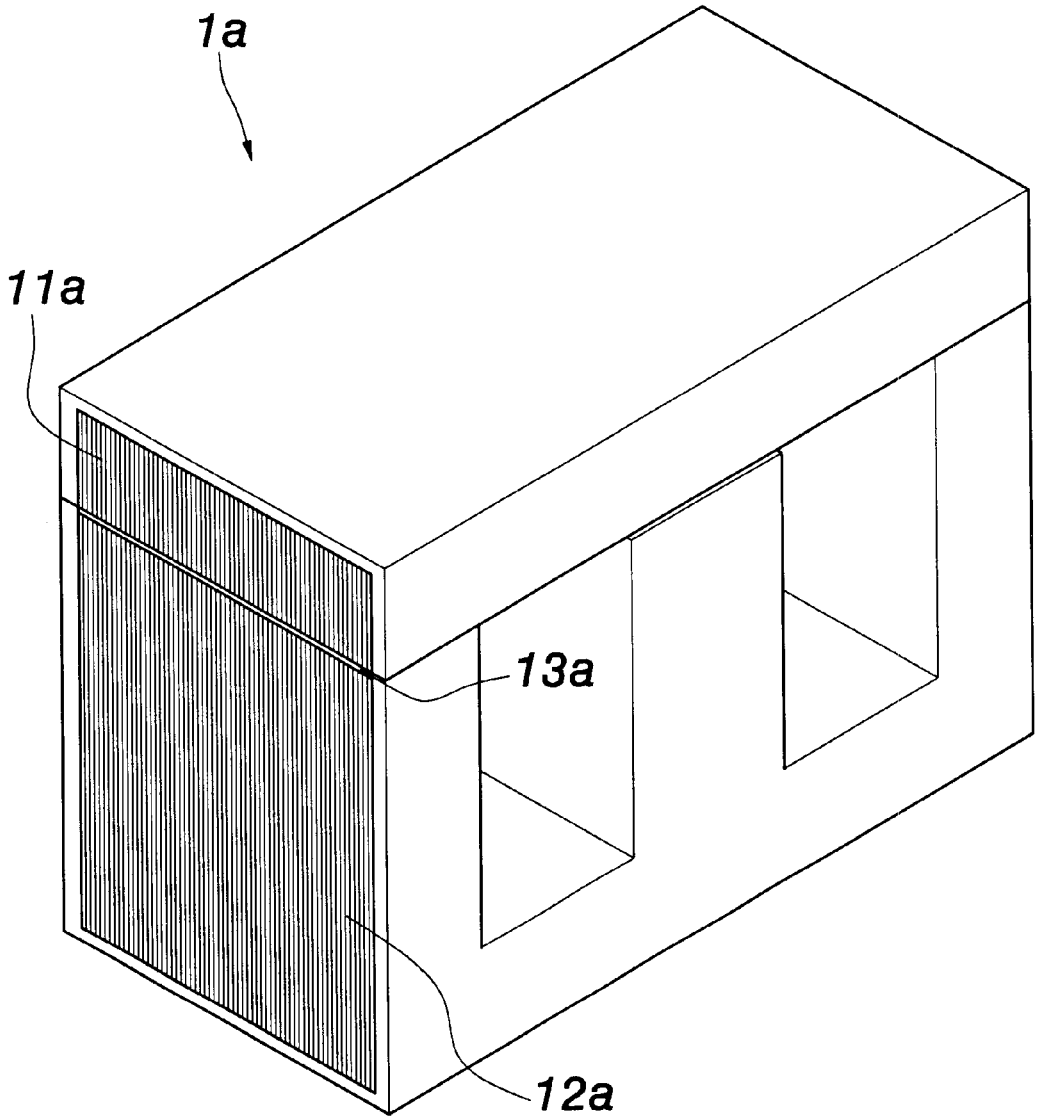
FIG. 1A PRIOR ART
FIG. 1A shows the perspective view of the prior art inductor.
Figure 1B:
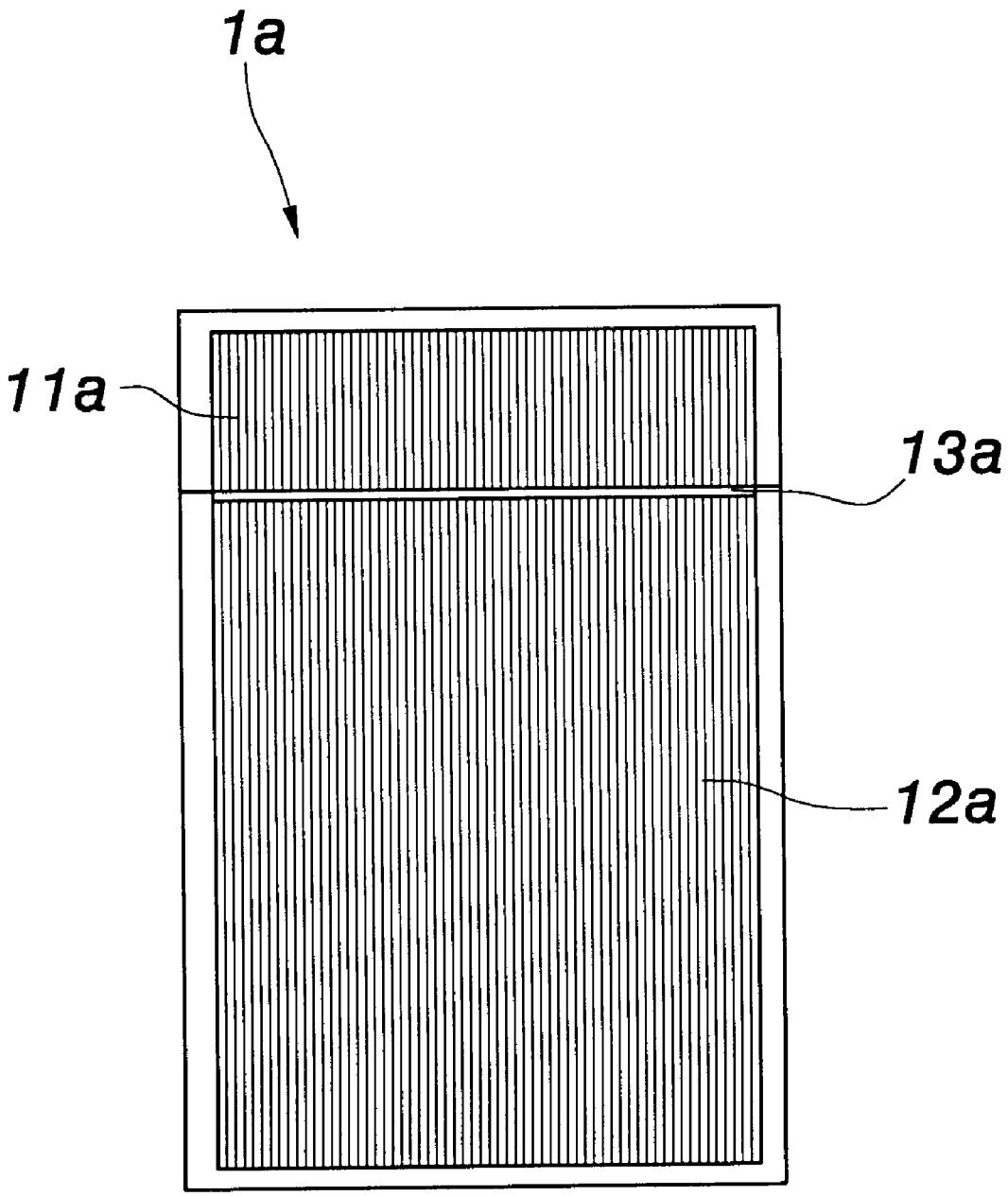
FIG. 1B PRIOR ART
FIG. 1B shows the front view of the prior art inductor.
Figure 2A:
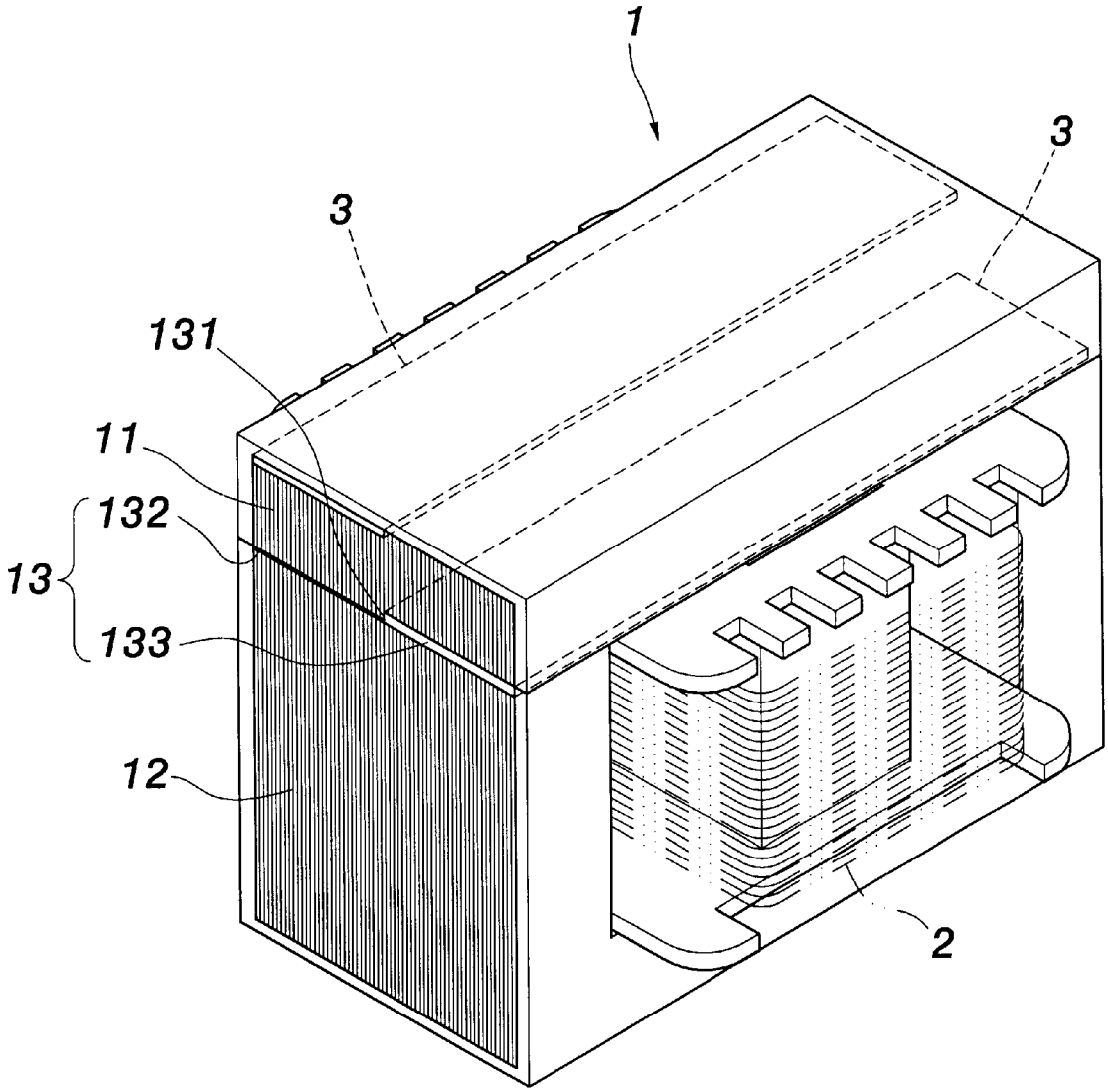
FIG. 2A shows the perspective view of the I-shaped silicon-steel plate padded with paper in the present invention.
Figure 2B:
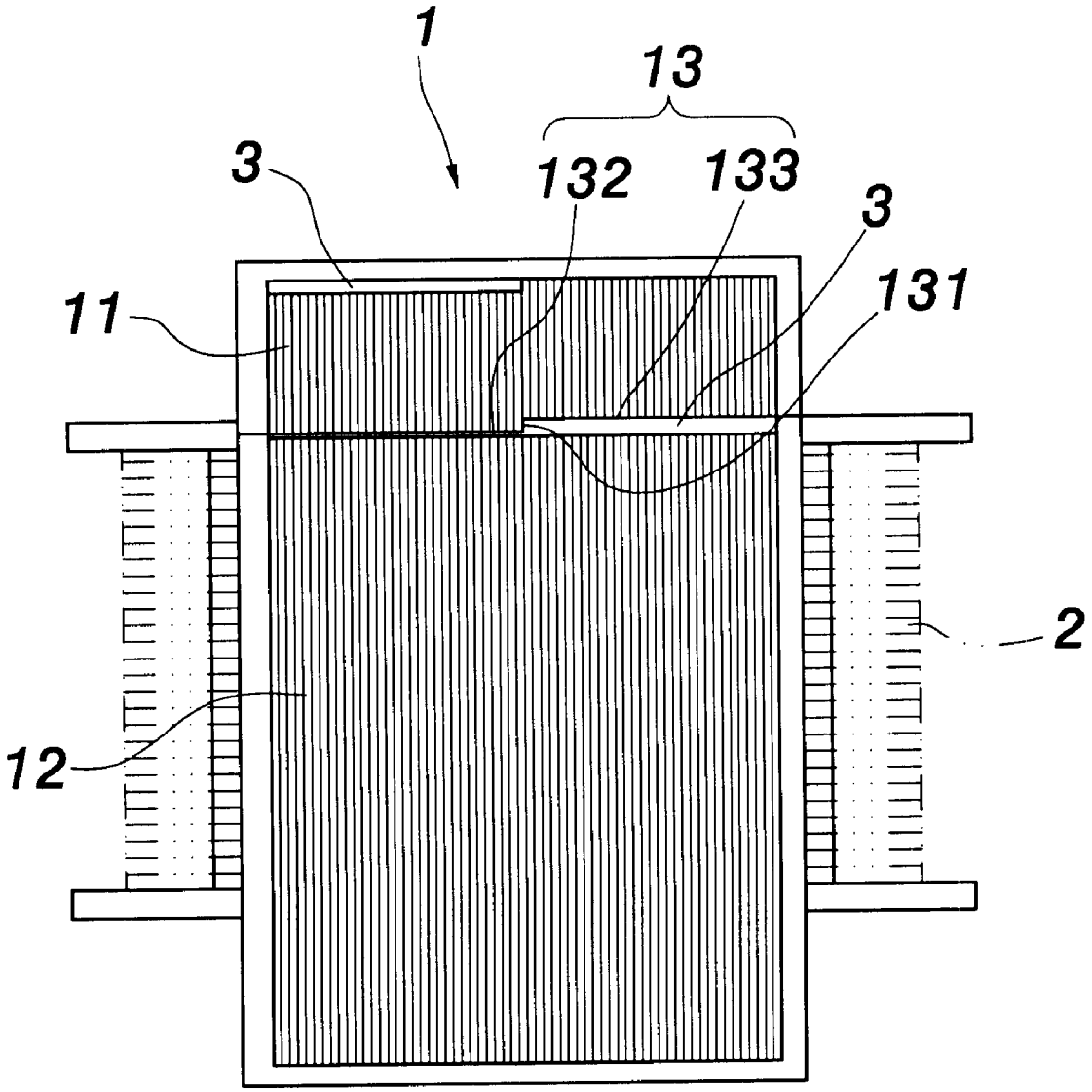
FIG. 2B shows the front view of the I-shaped silicon-steel plate padded with paper in the present invention.

With reference now to FIGS. 2A and 2B, the present invention provides an inductor with multiple air-gaps combination. The inductor according to the present invention is composed of a magnetic core 1 and an enameled wire 2 around the magnetic core 1. The magnetic core 1 is composed of a plurality of silicon-steel plates including an I-shaped silicon-steel plate 11 and an E-shaped silicon-steel plate 12. The I-shaped silicon-steel plate 11 is padded with papers 3 on topside and bottom side thereof to provide an air gap with various separations such that the surface 131 of the air gap 13 is of stair shape and composed of a small-gap portion 132 and a large-gap portion 133 to provide an air gap 13 with various separations.

Figure 3A:
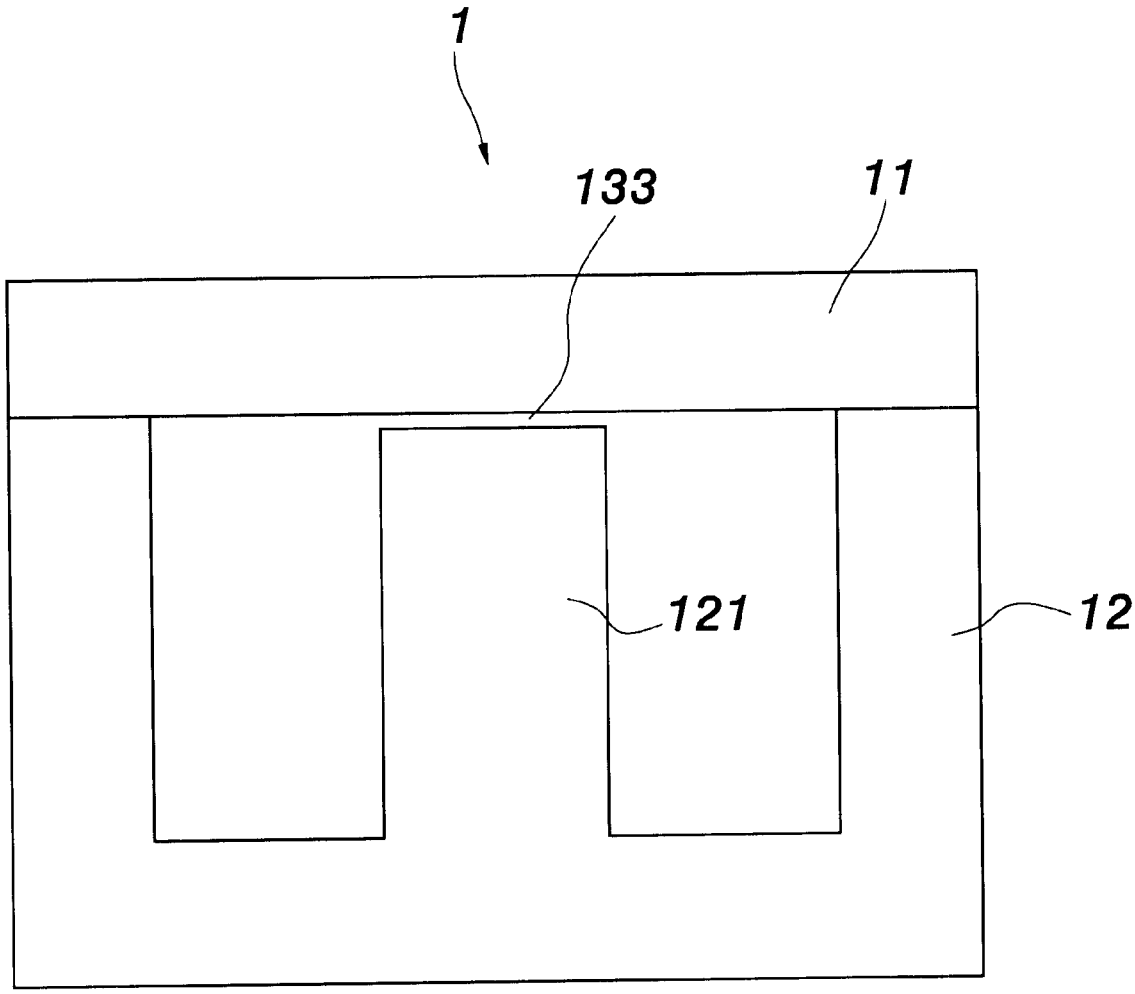
FIG. 3A is a left side view of B-shaped silicon-steel plate subjected to punching in the present invention.
Figure 3B:
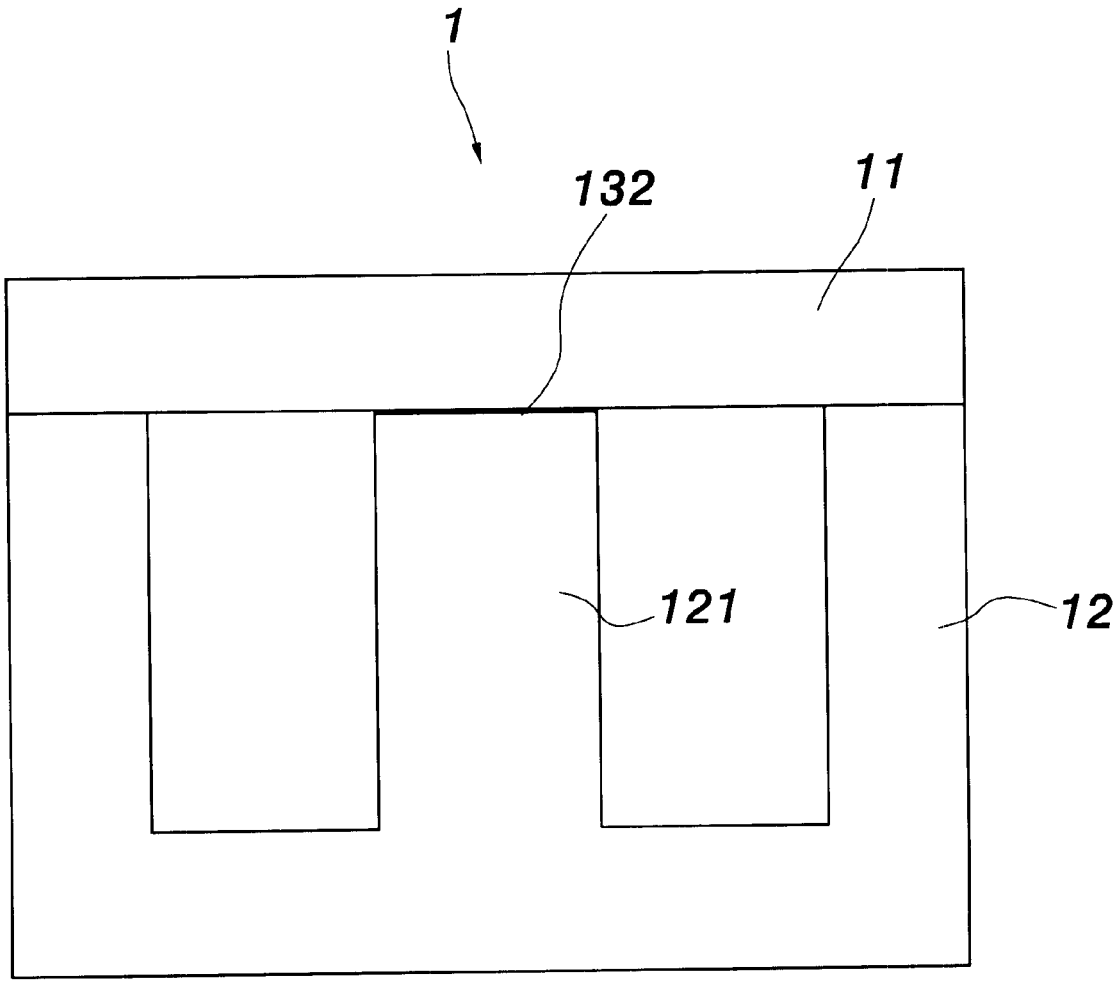
FIG. 3B is a right side view of B-shaped silicon-steel plate subjected to punching in the present invention.

The air gap 13 with various separations can be formed by other ways than padding with paper. As shown in FIGS. 3A and 3B, the center bar 121 of the E-shaped silicon-steel plate 12 is punched and pressed to form the small-gap portion 132 and the large-gap portion 133, before the enameled wire 2 is arranged.

Figure 4:
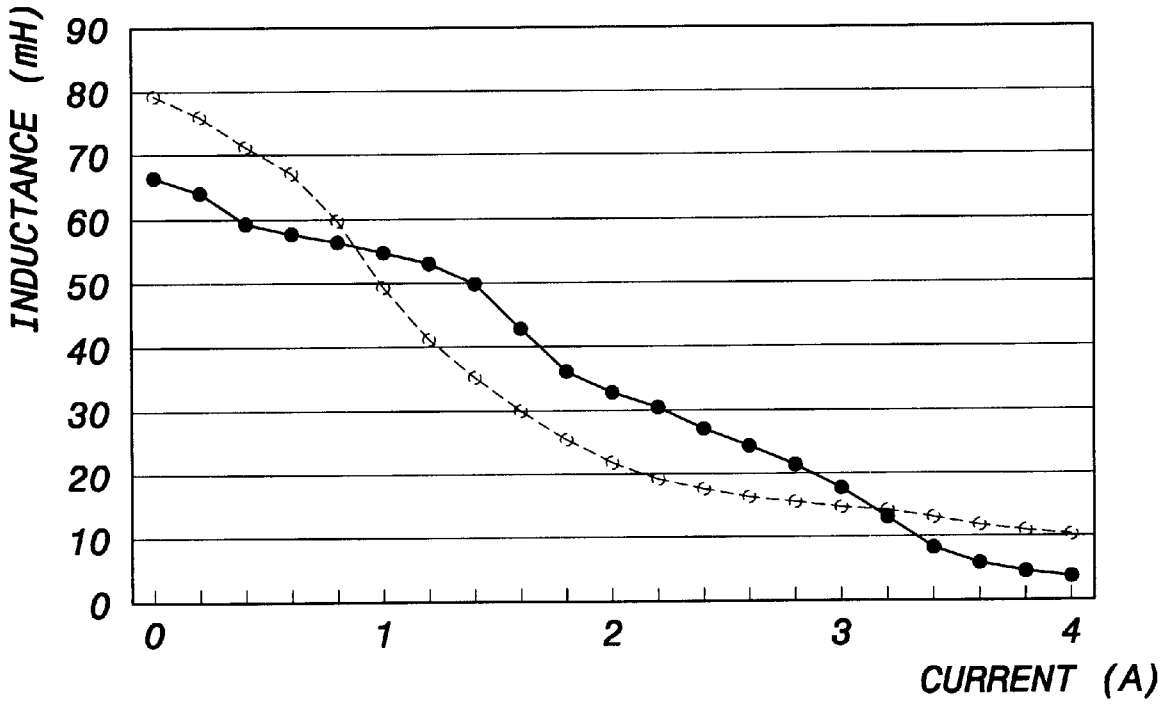
FIG. 4 shows the relationship between inductance and current of the inventive inductor.

Provided that the input power is 150 W, in the present invention, the small-gap portion 132 forms a separation of 5 mils (1 mil=0.001 inch), and the large-gap portion 133 forms a separation of 45 mils. Moreover, the small-gap portion 132 and the large-gap portion 133 each occupy 50% area of the air gap 13, i.e., the ratio is 1:1. The relationship between inductance and current of the inventive inductor is represented by the dashed line curve in FIG. 4. As compared with an inductor having an air gap with uniform separation of 12 mils (represented by the solid line curve in FIG. 4), the inventive inductor with air gap portions of various separation has larger inductance in conditions of large current (3–4 A) and small current (below 0.9 A).

Therefore, the small-gap portion 132 of the inventive inductor provides enough inductance in case of low load input to prevent harmonic distortion. The large-gap portion 133 of the inventive inductor provides enough inductance in case of heavy load output and low input voltage to prevent saturation and temperature rise, thus enhancing power efficiency. The electrical property of the inventive inductor can be optimized by controlling the various separations.

Figure 5A:
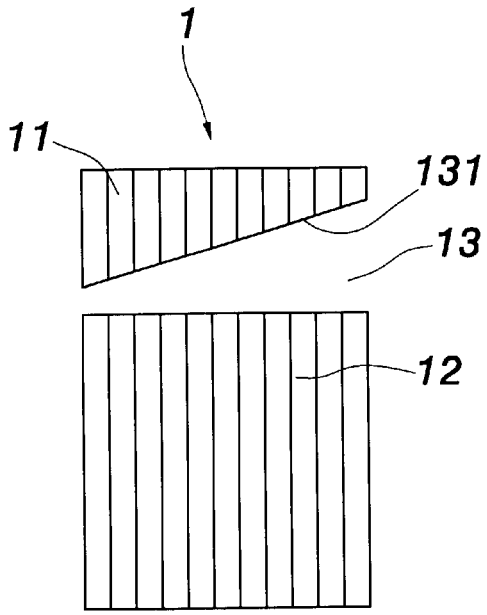
FIG. 5A is a front view of air gap with bevel plane in the present invention.
Figure 5B:
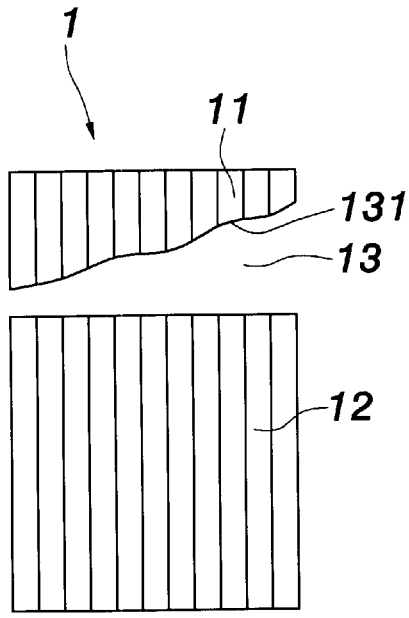
FIG. 5B is a front view of air gap with a curved surface in the present invention.

Moreover, as shown in FIGS. 5A and 5B, the surface 131 of the air gap 13 can also be bevel plane or a curved surface.

To sum up, the inductor with multiple air-gap separations according to the present invention has following advantages:

(1) The harmonic distortion can be prevented in low load condition.

(2) The temperature rise can be prevented in condition of heavy load output and low input voltage.

(3) The power efficiency is enhanced.

(4) The volume of inductor is reduced.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

We claim:

1. An electric inductor comprising:

a first magnetic core segment having a first cross-sectional profile defined by relative placement of adjacent ones of a first plurality of silicon-steel plates;

a second magnetic core segment having a second cross-sectional profile disposed in spaced apart relation to said first magnetic core segment, said first cross-sectional profile and said second cross-sectional profile defining therebetween a plurality of widening air-gap regions, each said widening air-gap region including adjacent small and large air gap portions, said large air gap portion being greater in width than said small air gap portion to define a stepped transition; and an enameled wire wrapped around at least one of said first and second magnetic core segments for carrying said electric current through the electric inductor.

2. An electric inductor comprising:

first and second magnetic core segments each including a plurality of stacked silicon-steel plates;

said first magnetic core segment having a first cross-sectional profile;

said second magnetic core segment having a second cross-sectional profile disposed in spaced apart relation to said first magnetic core segment, said first cross-sectional profile and said second cross-sectional profile defining therebetween a plurality of linearly widening air-gap regions, each said linearly widening air-gap region including both small and large air gap portions separated by an intermediate portion extending transversely relative to said stacked silicon-steel plates, said intermediate portion increasing linearly in width between said small and large air gap portions; and an enameled wire wrapped around at least one of said first and second magnetic core segments for carrying said electric current through the electric inductor.

3. An electric inductor comprising:

a first magnetic core segment having a first cross-sectional profile;

a second magnetic core segment having a second cross-sectional profile disposed in spaced apart relation to said first magnetic core segment, said first cross-sectional profile and said second cross-sectional profile defining therebetween a plurality of widening air-gap regions, each said widening air-gap region including both small and large air gap portions separated by an intermediate portion extending curvilinearly therebetween, said large air gap portion being greater in width than said small air gap portion; and, an enameled wire wrapped around at least one of said first and second magnetic core segments for carrying said electric current through the electric inductor.

4. The electric inductor as recited in claim 3, wherein said first magnetic core segment and said second magnetic core segment include a plurality of stacked silicon-steel plates.

* * * * *